US010518158B1

(12) United States Patent
Muller

(10) Patent No.: US 10,518,158 B1
(45) Date of Patent: Dec. 31, 2019

(54) GOLF PRACTICE AID FOR IMPROVING A GOLFER'S PUTTING AND SHORT GAME SKILLS

(71) Applicant: J. Joseph Muller, St. Louis, MO (US)

(72) Inventor: J. Joseph Muller, St. Louis, MO (US)

( * ) Notice: Subject to any disclaimer, the term of this patent is extended or adjusted under 35 U.S.C. 154(b) by 0 days.

(21) Appl. No.: 16/104,527

(22) Filed: Aug. 17, 2018

(51) Int. Cl.
*A63B 69/36* (2006.01)
*A63B 102/32* (2015.01)

(52) U.S. Cl.
CPC ..... *A63B 69/3641* (2013.01); *A63B 2102/32* (2015.10)

(58) Field of Classification Search
CPC . A63B 69/36; A63B 69/3676; A63B 2220/20; A63B 57/00; A63B 57/40; A63B 57/357; A63B 69/3641; A63B 2102/32
USPC ..... 473/405, 406, 407
See application file for complete search history.

(56) References Cited

U.S. PATENT DOCUMENTS 1,638,914 A * 8/1927 Brush ..... G01B 3/56 235/61 S
3,604,711 A * 9/1971 Hansburg ..... A63B 69/3676 273/DIG. 21
3,834,030 A * 9/1974 Hanson ..... A63B 57/00 33/759
4,128,245 A * 12/1978 Vlach ..... A63B 69/36 473/218
4,273,329 A * 6/1981 Trigg ..... A63B 57/00 473/407
4,440,168 A * 4/1984 Warren ..... A61B 17/15 33/512
4,532,712 A * 8/1985 Vistain ..... A63B 57/00 33/613
4,880,232 A * 11/1989 Lang ..... A63B 57/40 473/176
4,928,417 A * 5/1990 Boudreau ..... G09F 23/00 40/660
4,934,060 A * 6/1990 Evans ..... A63B 69/3688 33/393
4,989,877 A * 2/1991 Bias ..... A63B 69/0079 273/DIG. 21
5,257,808 A * 11/1993 Mueller ..... A63B 69/3623 473/174
5,478,071 A * 12/1995 Barrs ..... A63B 69/3676 473/176
D378,279 S * 3/1997 Pischette
5,788,581 A * 8/1998 Mabie ..... G09F 23/00 473/175

(Continued)

*Primary Examiner* — Raleigh W Chiu
(74) *Attorney, Agent, or Firm* — Sandberg Phoenix & von Gontard P.C.

(57) ABSTRACT

A golf practice aid (10) for establishing a circular pattern about a golf cup (C) includes a disk (12) sized to fit into the mouth of the cup. Radial lines (24) formed on the disk are evenly spaced about the disk and extend from the center to an outer edge thereof. A cord (16) of a predetermined length is tethered to the disk and is extendible outwardly from the disk to be sequentially drawn along each line, with a a marker (M) placed adjacent the outer end of the cord when the cord is fully extended. By extending the cord successively along each radial line, a circular pattern of a defined radius is formed by the markers placed about the cup, the circular pattern assisting golfers in practicing their putting, chipping, pitching, and bunker pay skills in accordance with a method of the invention.

13 Claims, 3 Drawing Sheets

(56) References Cited

U.S. PATENT DOCUMENTS 6,416,420 B1 * 7/2002 Stark ..... A63B 24/0003 473/257
7,269,869 B1 * 9/2007 Ruffino ..... A45F 5/02 7/164
7,708,658 B2 * 5/2010 McInerney ..... A63B 21/153 473/407
7,815,530 B2 * 10/2010 Cannata ..... A63B 57/00 473/407
7,988,572 B1 * 8/2011 Sweeney ..... A63B 57/00 473/407
8,801,546 B2 * 8/2014 Roark ..... A63B 67/068 33/759
D712,496 S 9/2014 Muller
2002/0177493 A1 * 11/2002 Harvot ..... A63B 57/00 473/405
2005/0181885 A1 * 8/2005 Yamanaka ..... A63B 69/3641 473/257
2007/0021231 A1 * 1/2007 Rutherford ..... A63B 45/02 473/280
2007/0075106 A1 * 4/2007 Meeh ..... A63B 57/00 224/274
2009/0088266 A1 * 4/2009 McInerney ..... A63B 21/153 473/226
2009/0119938 A1 * 5/2009 Song ..... A63B 57/353 33/366.14
2009/0318247 A1 * 12/2009 Cannata ..... A63B 57/00 473/407
2013/0053158 A1 * 2/2013 Downing ..... A63B 63/00 473/174
2013/0303298 A1 * 11/2013 Riedl ..... A63B 69/3676 473/257
2013/0324273 A1 * 12/2013 Reino ..... A63B 69/3676 473/176
2015/0283436 A1 * 10/2015 Daugard ..... A63B 57/00 473/150
2019/0070479 A1 * 3/2019 Elzinga ..... A63B 69/3676

* cited by examiner

FIG. 2A
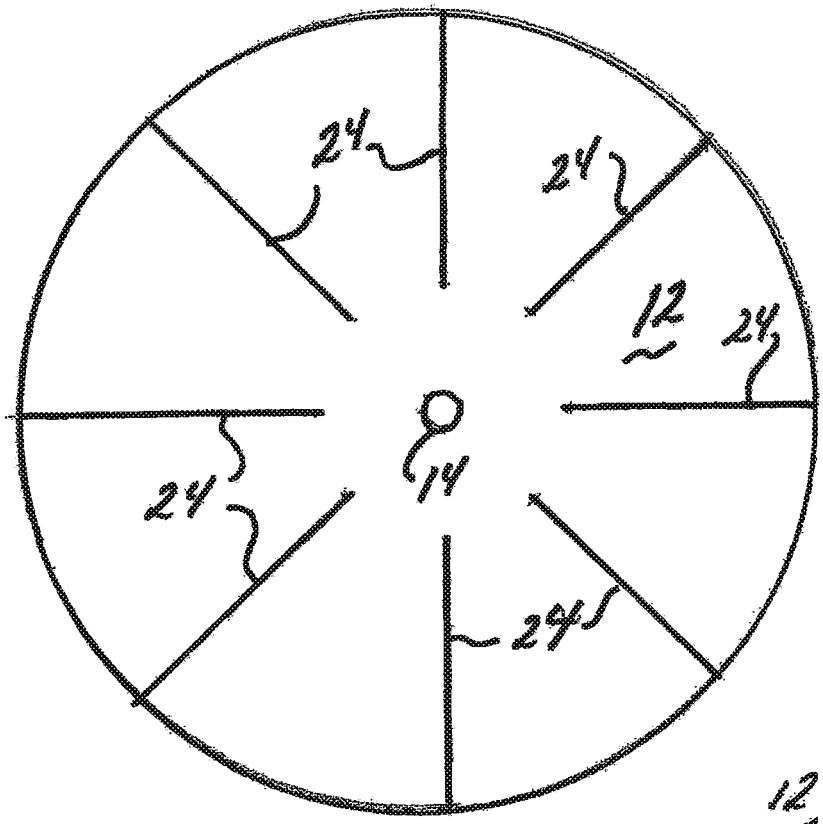
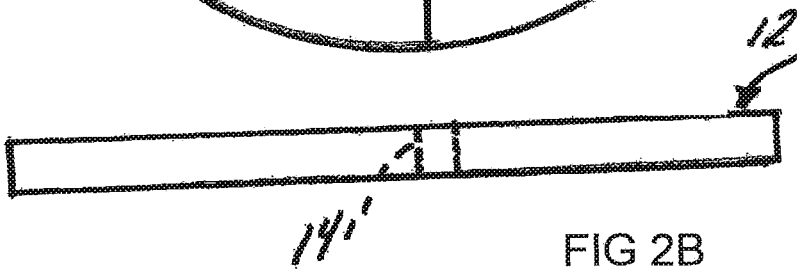
FIG 2B
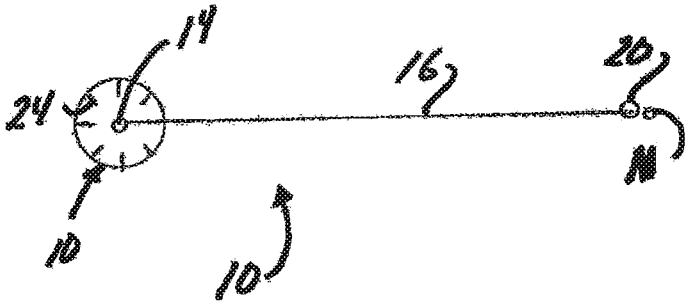
FIG. 4A

GOLF PRACTICE AID FOR IMPROVING A GOLFER'S PUTTING AND SHORT GAME SKILLS

BACKGROUND OF THE INVENTION

This invention relates to the improvement of a golfer's short game skills; and, more particularly to a practice aid for use by a golfer in improving their putting, chipping, pitching, and bunker play.

Today's golf game has, in many respects, become a power game. Better golfers, touring professionals and the like, typically hit their driver's 300 yards and further. On many golf holes, such prodigious length of the tee results in the golfer only having to hit a short iron onto a green, with the prospect of then having to make one or two putts for a birdie or an eagle.

Nonetheless, certain factors still come into play. Even the best golfers typically only hit onto 65-70% of the greens in regulation during a round of play. That's approximately 11-13 greens meaning that in order to par or birdie a hole, they still need to get up and down 5-7 times a round to shoot par or better for the round. Studies have also shown that during a round of golf, roughly $\frac{2}{3}^{rd}$'s of the shots played by a golfer, at any level of skill, occur within 100 yards of the cup. This includes fairway shots, shots from the rough, bunker shots, shots from the fringe of the green, and putts. All of this is generally referred to as the "short game". Accordingly, it is generally well accepted that the easiest way for a golfer to lower their scores is to improve their short game.

One of the basic tenets of the short game is the ability of a golfer to consistently hit their shots to within a 3' circle about the golf cup. Studies have shown that from within the 3' circle; i.e., a distance of 3' or less from the ball to the center of the cup, golfers can consistently make 90% or more of their putts. From this range outwardly, the make percentage falls off dramatically. Therefore, regardless off the type of shot played; putt, chip, pitch, bunker shot, if the golfer can consistently have their ball finish within the 3' circle, they should be able to consistently make the putt, thereby lowering their scores.

The present invention is a practice aid for use by golfers to improve their ability to make putts from 3', as well as to improve their ability to hit longer shots to within the 3' circle.

SUMMARY OF THE INVENTION

The present invention is directed at a practice aid for assisting golfers in improving their short game skills by establishing a circular pattern about a golf cup.

A disk sized to fit within the mouth of the cup has a cord attached to it the length of which is 3' from the edge of the disk to the outer end of the cord. A series of radial lines equidistantly spaced around the top of the disk extend outwardly from the center of the disk to its outer edge. The cord is extended from the center of disk sequentially along each of the radial lines with a marker being placed in or on the ground adjacent the outer end of the cord. When the sequence is completed, a circular pattern has been formed on the surface of the green each point on the circle being 3' from the edge of the cup. The disk is then removed.

Thereafter, a golfer can use the 3' circle as a basis for practicing and improving his short game. This includes practicing making 3' putts, trying to have longer putts finish within the 3' circle, and having shots from off the green; chips, pitches, and bunker shots finish within the 3' circle. Being able to consistently hole 3' putts, and having one's other shots finish within the 3' circle will help a golfer significantly lower his scores.

The practice aid is easy to assemble and is readily stored in a golf bag, locker, or car trunk.

The practice aid is also inexpensive to buy and can easily be set up and used on a golf course, a practice green, driving range, or someone's backyard.

Other objects and features will be in part apparent and in part pointed out hereinafter.

BRIEF DESCRIPTION OF THE DRAWINGS

FIGS. 2A and 2B are respective top plan and side views of a disk used with the golf practice aid of the present invention;

FIGS. 4A and 4B illustrate the disk and cord assembled together to form the practice aid and establish a 3' circle about a golf cup; and, FIG. 5 illustrates a second cord used with the disk for forming circles of different radii about a cup or a spiral pattern;

Corresponding reference characters represent corresponding elements throughout the several views of the drawings.

DESCRIPTION OF A PREFERRED EMBODIMENT

Figure 1:
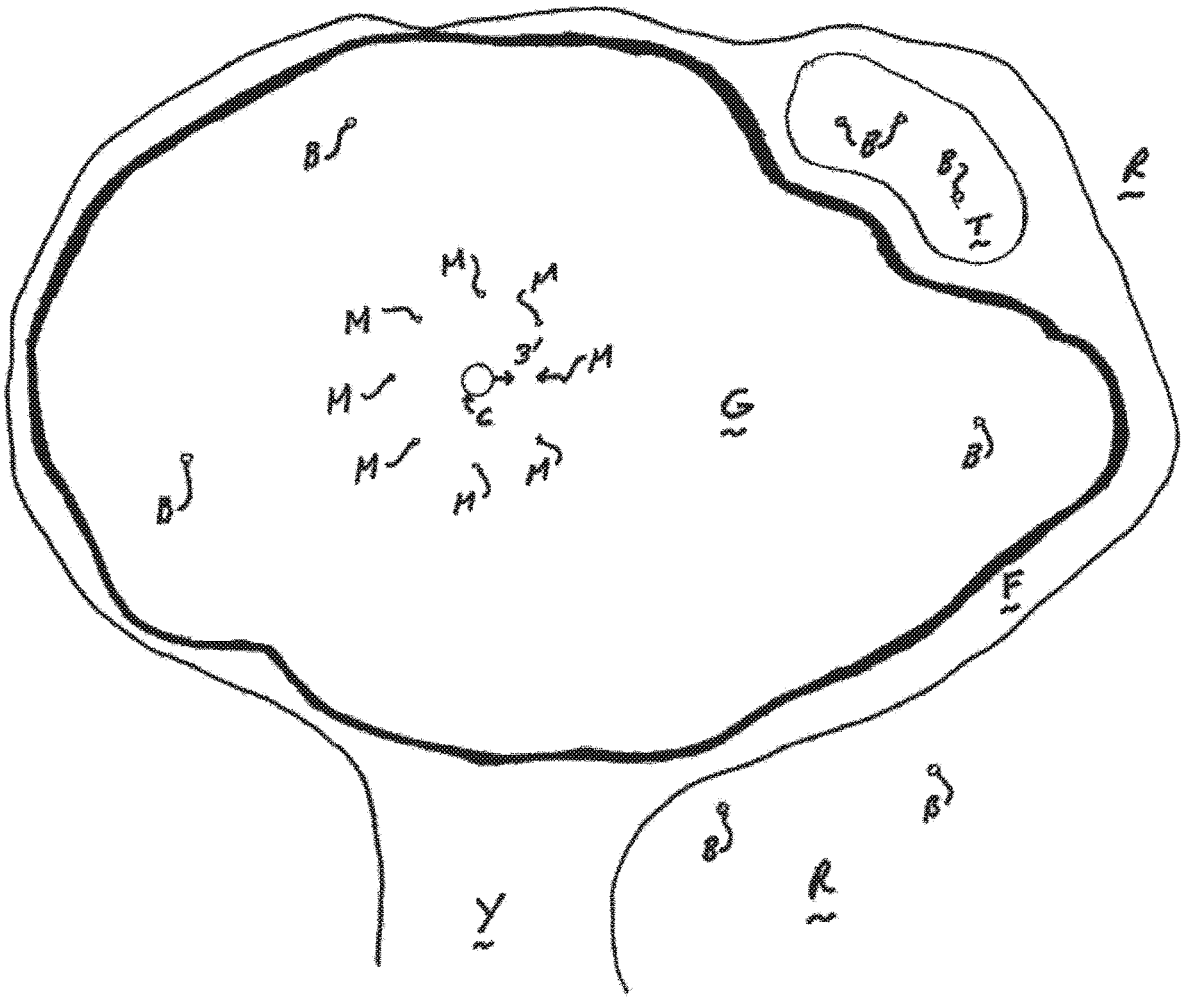
FIG. 1 is a representation of a golf green and its surrounds.

Referring to the drawings, a golf green, indicated generally G, has a hole or cup C located on it, the position shown in FIG. 1 being representational only. The cup is of a standard size having a diameter of 4¼ ". As is well-known, the object of the game of golf is for a golfer to get his ball B into cup C from a teeing area (not shown) using the fewest number of strokes Green G is located at the end of an area of closely mown grass referred to as a fairway Y. The green may also have a fringe area F of grass slightly taller than the grass on the green and extending partially or fully about the green. Areas of taller grass on the sides of the fairway and extending around the green beyond fringe F are referred to as rough R. In addition, greens often have areas of sand located adjacent to them, these areas being referred to as bunkers or sand traps T. In trying to get their ball from the teeing area into the cup, a golfer tries to hit their shot into the fairway, although the ball may often finish in the rough or a bunker.

One way for a golfer to lower their overall score for a round of golf is for them to reduce the number of strokes they make on and around the green to get their ball into the cup C. Practice aid 10 of the present invention (see FIGS. 4A and 4B) allows them to set up a practice station by which they can practice consistently making putts from a predetermined short distance; i.e., 3 feet (3'), from cup C. In addition, practice aid 10 enables the golfer to establish a defined target area (i.e., a 3' circle about cup C) for practicing their longer putts, chip, shots, pitch shots, and bunker shots. In this practice, the goal is for the golfer to consistently have their shots finish within the perimeter of the 3' circle.

Golf practice aid 10 first includes a disk 12 which is a round disk having a diameter corresponding to that of cup C. This allows disk 12 to be set in the mouth of cup C, see FIG.

4B, when a pin (not shown) is removed from the cup. Disk 12, which is made in accordance with U.S. design Pat. D712,496 by the same inventor as the present application, has a central opening 14.

Figure 3A:
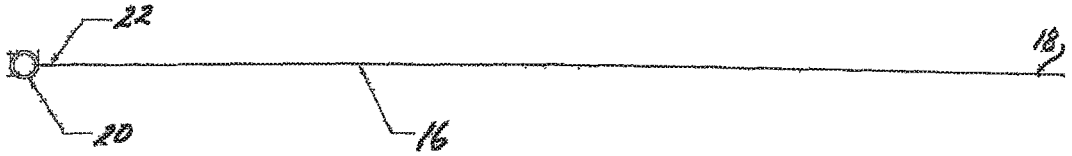
FIGS. 3A and 3B are respective top plan and side views of a cord used with the golf practice aid.
Figure 3B:
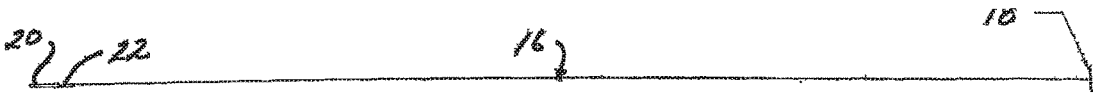
Figure 4B:
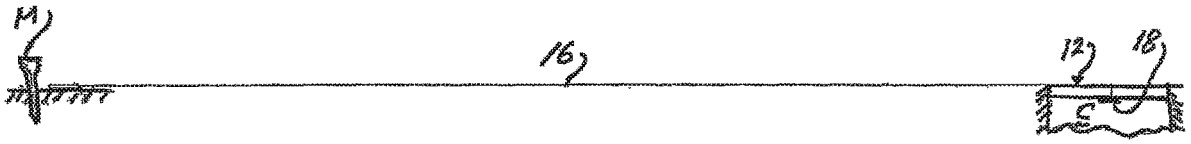

Next, referring to FIGS. 3A and 3B, practice aid 10 includes a cord or tether 16. Cord 16 is a flexible cord to one end of which a pin shaped fastener 18 is attached. Fastener 18 is sized to fit through opening 14 in disk 12 and catch on the underside of disk 12 (as shown in FIG. 4B) so to tether the cord to the disk. A ring 20 is fastened to the other end of the cord by a metal coil 22. When disk 12 is fitted into the mouth of cup C as shown in FIG. 4A and cord 16 is extended as shown in FIGS. 4A and 4B, the distance between the perimeter or outer edge of disk 12, and the outer reach of ring 20 is approximately 3' or slightly longer (an inch or less) than 3'.

As shown in the FIGS. 2A and 4A, disk 12 has a series of equidistantly spaced lines 24 extending radially outwardly from the center of the disk to its outer edge. The number of radial lines may vary from one disk 12 to another. For example, the number of lines 24 may be 3, 4, 5, 6, 8, 9, 10, 12, or more. The number of lines is selected so that the angle between the lines is readily divisible into 360°. For the above listed numbers, the angle between adjacent radial lines is 120°, 90°, 72°, 60°, 45°, 40°, 36°, and 30° respectively, The disks shown in the drawings each have 8 radial lines spaced 45° apart. It will be understood that there could be more radial lines than noted above without departing from the scope of the invention; although having more than 12 radial can make practicing, after the practice station is established, cumbersome.

The radial lines 24 may be inscribed on the top surface of the disk; or, a decal on which the lines are printed may be affixed to the top surface of the disk; or, the top surface of the disk may be screen printed or pad printed with the lines. The radial lines may all be of the same color, or alternating colors such as red and blue, for example, or another combination of colors. What is important is that the color of the lines contrasts with the color of the top of the disk or decal, so that the radial lines readily stand out.

As shown in FIG. 4B, after a flag or pin (both not shown) is removed from cup C, disk 12, with cord 16 attached is set in the mouth of the cup. Then, the cord is sequentially extended along each of the radial lines. The cord is then drawn along a respective radial line until it is fully extended (the cord does not need to be pulled taut), and then a marker M is placed adjacent the outer extent of ring 20. Marker M may be one of a number of markers including, for example, a tee T such as shown in FIG. 4B, a ball marker (not shown), or a coin N such as shown in FIG. 3A. Alternately, if the golfer has a marker such as a Sharpie® or Hi-Liter®, they can use that to make a colored mark on the surface of the green adjacent the outer extent of ring 20.

Referring again to FIG. 1, a series of eight markers M are shown placed about cup C, using practice aid 10 as described herein, to define a circle about the cup. Once this circular pattern is established, disk 12 of practice aid 10 is removed from the mouth of cup C and the flag or pin can be set back into the cup if the golfer so desires.

Once the 3' circle is established, the golfer can practice all facets of their short game. For example they can place a golf ball adjacent each of the markers M and attempt to putt the ball into the cup. Given the contouring of most greens G, in going around the cup, they will have straight putts, uphill and downhill putts, side hill putts, and left-to-right and right-to-left breaking putts. One practice drill, for example, is to start at one point on the circle and go around it putting the ball at each marker location into the cup. If the golfer misses a putt, they have to start over until they make all of the putts in a row.

Another drill is for the golfer to putt all of the balls they place on the green some distance from the cup into the 3' circle defined around the cup. Consistently being able to do so should give the golfer confidence in making the next putt. It has been found that, in doing this practice, a golfer will actually start to make more of the longer putts.

For shots from fairway Y, fringe F, rough R, and bunker or sand trap T, the golfer's goal is to hit their wedge or other short iron, chip, pitch, or bunker shot, so that it finishes within the 3' circle defined around the cup. Again, consistently being able to do so should give the golfer confidence in making the follow-up putt so they can get up and down from these areas with fewer shots than they used to; again helping lower their scores.

Figure 5:
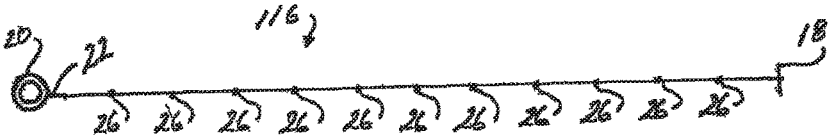

While golf practice aid 10 has been described for use in setting up a 3' circle about a cup C, it will be understood by those skilled in the art that, depending on the length of cord 16, circles of greater or lesser radiuses can also be set up using the practice aid. In addition, cord 16 can have marks made on it at intermediate points along its length. As shown in FIG. 5, a cord 116 has a knot or ring or band 26 located, for example, every 6" along the length of the cord. Such a cord, which is longer than cord 16, is tethered to disk 12 as previously described.

Using cord 116, a golfer can form a series of concentric circles about cup C, by using first one knot/ring/band 26, and then another in the manner described above. Alternately, the golfer can form a spiral pattern about the cup by placing a marker adjacent one of the knot/ring/band 26, when the cord is extended along one of the radial lines 24, and then, when the cord is extended along the next radial line 24, placing the marker at the next, more distant knot/ring/band. By creating a spiral pattern, the golfer now has the ability to practice a series of putts which will not only be affected by the contour of the green about the cup, but also the increasing distances from the cup. It will be appreciated that different spiral patterns are formed depending on whether the golfer moves clockwise or counter-clockwise around the cup when setting up the practice station.

Cord 16 can also be attached to disk 12 in other ways than that described above. For example, a screw post of appropriate size can be fitted through opening 14 in the center of the disk. Now, cord 16 has a loop formed at its one end and attached to the outer end of the screw post so to be rotatable over the top of the disk. Or, a post of the same diameter as the opening, but longer than the thickness of the disk, can be inserted through the opening with cord 16 again having a loop formed in its one end which fits over the portion of the post extending above the top of the disk for the cord to be rotatable over the top of the disk.

An advantage of practice aid 10 is that it allows a golfer to set a practice station on a golf green, a putting green or practice green (a practice green being one a golfer can chip or pitch to, but not putt on); or, in one's yard. Set up time using practice aid 10 is on the order of 1½-2 minutes, after which time the golfer can perform all of the types of short game practice noted above for as long as the golfer wants.

Practice aid 10 is light in weight and compact. Disk 12 and cord 16 fit, for example, in a sandwich type Ziploc® bag. Accordingly, the practice aid can be stored in a golfer's golf bag, locker, car trunk, etc.

In view of the above, it will be seen that the several objects and advantages of the present invention have been achieved.

What is claimed is:

1. A golf practice aid for establishing a circular pattern about a golf cup set in a golf green for assisting a golfer in practicing and improving their putting, chipping, pitching and bunker play skills, comprising:

a circular disk having a diameter corresponding to the diameter of the cup to fit within the cup when a pin or flag is removed from the cup with an upper, top surface of the disk being flush with the top of the cup and the ground surrounding the cup when the disk is in place, the disk having flat planar upper top and lower bottom surfaces extending parallel to each other and with nothing projecting or extending from either the upper or lower surface, and a straight vertical sidewall extending completely about a circumference of the disk, a plurality of radial lines formed on the top surface of the disk, the radial lines being equidistantly spaced about the disk with each radial line extending outwardly from a center of the disk to an outer edge thereof with angles formed between adjacent radial lines being uniform about the disk;

a central circular opening formed in the disk which is smaller in diameter than the diameter of a golf ball; and, a flexible cord tethered to the disk and having a pin attached to one end thereof which, in an upright position is inserted through the central opening in the disk from the top of the disk and when completely inserted therethrough is rotated so as to catch against the bottom of the disk and tether the cord to the disk, and a ring attached to an opposite end of the cord for extending the cord outwardly from the disk along each radial line whereby when the cord is fully extended, a marker is placed adjacent an outer extent of the ring, the marker being a predetermined distance from the outer edge of the disk and the cup and with a circular pattern of a defined radius formed by the markers after the cord has been extended along each radial line and a marker put in place, with the disk being thereafter removed from the cup to allow a golfer to commence practice.

2. The practice aid of claim 1 in which the number of lines on the top surface of the disk is selected so that the angle between the lines is readily divisible into 360°.

3. The practice aid of claim 2 in which the lines are formed on the disk by one of:

inscribing them on the top surface of the disk; or, affixing a decal to the top surface of the disk the decal having the lines printed on it; or, screen printing or pad printing the lines on the top surface of the disk.

4. The practice aid of claim 2 in which all the lines are of a contrasting color to the color of the top surface of the disk so to be readily visible.

5. The practice aid of claim 1 in which the predetermined length of the cord is such that the distance between an outer edge of the cup and each marker is a predetermined distance.

6. The practice aid of claim 5 in which the cord has marks made along its length with adjacent marks being equidistant from each other so to enable the practice aid to be used to set up concentric circle patterns about the cup.

7. The practice aid of claim 6 in which the cord further allows spiral patterns to be made about the cup.

8. A method of establishing a circular pattern of a predetermined radius about a golf cup set in a golf green to assist a golfer in practicing and improving their putting, chipping, and bunker play skills comprising:

removing a flag or pin from the cup if one is in the cup;

tethering a flexible cord to a disk sized to fit within a perimeter of the cup, one end of the cord having a pin attached thereto which, in an upright position, is inserted through a central opening in the disk from a top surface of the disk and when completely inserted through the disk is rotated so as to catch against a bottom surface of the disk and tether the cord to the disk;

once the cord is tethered to the disk, inserting the disk into the cup with the top surface of the disk being flush with the top of the cup and the ground around the cup when the disk is in place;

extending the cord outwardly along one of a plurality of radial lines formed on the top surface of the disk using a ring attached to an opposite end of the cord, the radial lines being equidistantly spaced about the disk with each radial line extending outwardly from a center of the disk to an outer edge thereof with angles formed between adjacent radial lines being uniform about the disk;

when the cord is fully extended, placing a marker adjacent an outer extent of the ring, the marker being a predetermined distance from an edge of the cup and an outer edge of the ring;

sequentially extending the cord along each of the radial lines formed on the top surface of the disk and placing a marker at an outer extent of the ring when the ring is fully extended whereby when all of the markers have been placed, a circular pattern of a predetermined radius is formed about the cup; and, thereafter, removing the disk from the cup to allow a golfer to commence practice.

9. The method of claim 8 further including placing a golf ball adjacent to each marker for a golfer to attempt to then sequentially putt each ball into the cup and having to repeat the process if a putted ball misses the cup.

10. The method of claim 9 further including a golfer placing a golf ball on the green some distance from the cup and outside the perimeter of a circle formed by the circular pattern and putting the golf ball toward the cup for the ball to finish within the circular pattern formed about the cup.

11. The method of claim 10 further including a golfer placing a golf ball off the green and chipping the golf ball from off the green toward the cup for the golf ball to finish within the circular pattern formed about the cup.

12. The method of claim 11 further including a golfer placing a golf ball off the green and pitching the golf ball from off the green toward the cup for the golf ball to finish within the circular pattern formed about the cup.

13. The method of claim 12 further including a golfer placing a golf ball in a bunker or sand trap and hitting the ball resting in the bunker or sand trap toward the cup with the ball finishing within the circular pattern formed about the cup.

* * * * *